US008434405B2

(12) United States Patent
Matsui et al.

(10) Patent No.: US 8,434,405 B2
(45) Date of Patent: May 7, 2013

(54) METHOD FOR SETTING OPERATION CONDITION OF PRESS LINE

(75) Inventors: Yasuhiro Matsui, Tochigi (JP); Tatsuya Sato, Tochigi (JP); Yoshihiro Kageyama, Tochigi (JP); Koji Ikohagi, Tochigi (JP); Hiroyuki Nobuta, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 186 days.

(21) Appl. No.: 13/120,563

(22) PCT Filed: Sep. 14, 2009

(86) PCT No.: PCT/JP2009/066017

§ 371 (c)(1),
(2), (4) Date: Jun. 10, 2011

(87) PCT Pub. No.: WO2010/035650

PCT Pub. Date: Apr. 1, 2010

(65) Prior Publication Data

US 2011/0239875 A1 Oct. 6, 2011

(30) Foreign Application Priority Data

Sep. 24, 2008 (JP) ..... 2008-244121

(51) Int. Cl.
*B30B 13/00* (2006.01)

(52) U.S. Cl.
USPC ..... 100/35; 100/45; 100/207; 72/405.01; 700/206

(58) Field of Classification Search ..... 100/35, 100/43, 45, 48, 140, 207, 208; 72/405.01, 72/405.05, 405.15, 405.16; 198/621.1; 83/563; 700/206

See application file for complete search history.

(56) References Cited

U.S. PATENT DOCUMENTS

| | | | | |
|---|---|---|---|---|
| 4,279,561 | A * | 7/1981 | Schneider et al. | 414/591 |
| 4,378,592 | A * | 3/1983 | Heiberger et al. | 700/206 |
| 4,414,887 | A * | 11/1983 | Orii | 100/45 |
| 6,742,457 | B2 * | 6/2004 | Shiroza | 101/485 |
| 7,187,996 | B2 * | 3/2007 | Tanaka et al. | 700/206 |
| 7,752,878 | B2 * | 7/2010 | Schmeink | 72/29.2 |

FOREIGN PATENT DOCUMENTS

| | | |
|---|---|---|
| JP | 5-76630 | 10/1993 |
| JP | 2002-316298 | 10/2002 |
| JP | 2003-245800 | 9/2003 |
| JP | 2006-073797 | 3/2006 |
| JP | 2010-087197 | 4/2010 |

* cited by examiner

*Primary Examiner* — Jimmy T Nguyen
(74) *Attorney, Agent, or Firm* — Rankin, Hill & Clark LLP

(57) ABSTRACT

A method for setting an operation condition of a press line includes a conveyance route setting step of setting a conveyance route so as to minimize a clearance between a work and a lower die; a phase difference setting step of setting a phase difference between conveying operations of respective conveyance machines so as to minimize a clearance between a work to be taken-out and a work to be taken-in; and a press-conveyance phase difference setting step that sets a phase difference between pressing operation and conveyance operation in accordance with the conveying route set for each conveyance machine, the phase difference between the conveyance machines, a line SPH, and a press SPH.

4 Claims, 6 Drawing Sheets

METHOD FOR SETTING OPERATION CONDITION OF PRESS LINE

TECHNICAL FIELD

The present invention relates to a method for setting an operation condition of a press line. More specifically, it relates to a method, which is a method for setting an operation condition of a press line provided with a plurality of press machines and a plurality of conveyance machines, setting an operation condition such as the raise/lower movement of these press machines and the conveyance movement of these conveyance machines.

BACKGROUND ART

Conventionally, with a press line in which a plurality of press machines is aligned, a conveyance machine is provided to convey works between press machines. The press line manufactures an article of a predetermined shape from a work of a flat plate shape through a plurality of pressing processes by each press machine. To each press machine, a different pressing process is assigned, respectively.

On the other hand, the conveyance machines provided between each press machine conveys a work from a press machine executing an earlier pressing process to a press machine executing a subsequent pressing process for each press machine undergoing raise/lower movement in a predetermined cycle. Therefore, it is necessary to set such that the conveyance movement of the conveyance machine does not interfere with the upper mold of such respective press machines undergoing raise/lower movement.

For example, a method of setting the conveyance movement of such conveyance machines has been shown in Patent Document 1. With this method of setting the conveyance movement, a plurality of reference forms of conveyance movement are prepared in advance. When practically setting the conveyance movement, one is selected from the plurality of reference forms prepared, and the initial position and final position of the conveyance machine is further specified. Since a reference form is selected and only the initial position and final position of the conveyance machine have to be specified according to this setting method, the time for setting of the conveyance movement of the conveyance machine can be shortened.

Patent Document 1: Japanese Unexamined Patent Application Publication No. 2004-255419

DISCLOSURE OF THE INVENTION

Problems to be Solved by the Invention

However, in a case of improving the production cycle of the overall press line, it is necessary to set the conveyance movement of the conveyance machines so that a work can be conveyed as quickly as possible in accordance with the cycle of raise/lower movement of the molds and press machines. However, with the setting method shown in Patent Document 1, the conveyance movement of the conveyance machines is set based on a reference form prepared in advance, and thus it is difficult to perform optimal setting in accordance with the raise/lower movement of the mold and press machine. Therefore, it is ultimately necessary to optimize settings based on the judgment of an operator after the press line has been practically operated.

The present invention has an object of providing a method for setting an operation condition of a press line that can improve the production cycle.

Means for Solving the Problems

According to the present invention, in a method for setting an operation condition of a press line (e.g., the press line 1 described later) provided with a plurality of press machines (e.g., the press machine 2 described later) that presses a work by raising and lowering an upper mold (e.g., the upper mold 22 described later) relative to a lower mold (e.g., the lower mold 21 described later), a plurality of conveyance machines (e.g., the conveyance machine 3 described later) that conveys a work between the press machines along a predetermined conveyance route (e.g., the conveyance route C described later), and a control device (e.g., the control device 4 described later) that controls cyclic raise/lower movement of each of the press machines and cyclic conveyance movement of each of the conveyance machines along the conveyance route, the method includes: a line speed setting step (e.g., Step S2 in FIG. 3 described later) of setting a line speed (e.g., the line SPM described later) indicating a work production capacity of the press line; a conveyance route setting step (e.g., Step S4 in FIG. 3 described later) of setting a conveyance route of the conveyance machine so that a clearance (e.g., ΔD1, ΔD2 described later) between the conveyance machine or the work conveyed by the conveyance machine and the lower mold is a minimum; a machining speed setting step (e.g., Step S6 in FIG. 3 described later) of setting a machining speed (e.g., the press SPM described later) indicating a work machining capacity of the press machine; a conveyance machine phase difference setting step (e.g., Step S7 in FIG. 3 described later) of setting a phase difference of conveyance movement between each of the conveyance machines (e.g., the conveyance machine phase difference ΔTH described later) so that a clearance (e.g., ΔL described later) between a work discharged from the press machine and a work delivered to the press machine is a minimum; and a press-conveyance phase difference setting step (e.g., Step S11 described later) of setting a phase difference between raise/lower movement of each of the press machines and conveyance movement of each of the conveyance machines (e.g., the press-conveyance phase difference ΔTP described later) based on the conveyance route of each of the conveyance machines, the phase difference of conveyance movement between each of the conveyance machines, the line speed, and the machining speed thus set in the steps.

According to the present invention, since the conveyance route of the conveyance machine is set so that the clearance between the conveyance machine or the work conveyed by the conveyance machine is a minimum after the line speed has been set, it is possible to set the conveyance route to a low position. In addition, since the phase difference of the conveyance movement between the respective conveyance machines is set so that the clearance between the work discharged from the press machine and the work delivered to this press machine is a minimum after the machining speed of the press machine has been set, it is possible to make the mold-inside time for which the two conveyance machines simultaneously stay within one press machine a minimum. In addition, the phase difference between the raise/lower movement of the respective press machines and the conveyance movement of the respective conveyance machines is set based on the conveyance route of the respective conveyance machines, phase difference of conveyance movements between the respective conveyance machines, line speed, and machining speed set as above.

As stated above, since by simply determining the shape of the conveyance machine and molds of the press machine, the optimum line speed, conveyance route and phase difference of conveyance movement between the respective conveyance machines, i.e. conveyance movement of the conveyance machines, can be set automatically in accordance with this shape, the production cycle of this press line can be improved. In addition, since insight into the production cycle of the press line is possible from the stage of designing the molds, the production schedule of the press line can be constructed at an early stage.

In this case, it is preferable for the line speed and the machining speed to be set to maximum values in the line speed setting step and the machining speed setting step, respectively.

According to the present invention, the conveyance route of the conveyance machine, the phase difference of conveyance movement between the respective conveyance machines, and the phase difference between the raise/lower movement of the respective press machines and the conveyance movement of the respective conveyance machines are set after the line speed and the machining speed have been set to maximum values, respectively. It is thereby possible to set the raise/lower movement of the press machine and the conveyance movement of the conveyance machine so that the production cycle of the press line can be improved overall.

In this case, an operability determination step (e.g., Step S9 in FIG. 3 described later) of determining whether the phase difference between raise/lower movement of each of the press machines and the conveyance movement of each of the conveyance machines set in the press-conveyance phase difference setting step can be set within an operable region is further included, in which the line speed is set to a smaller value, and the conveyance machine phase difference setting step, the press-conveyance phase difference setting step, and the operability determination step are executed again, in a case of the phase difference being determined not to be settable within the operable region in the operability determination step, and the phase difference is set within the operable region in a case of the phase difference having been determined to be settable within the operable region in the operability determination step.

According to the present invention, it is determined whether the phase difference between the raise/lower movement of the respective press machines and the conveyance movement of the respective conveyance machines can be set within an operable region, and in a case of having been determined not to be settable, the phase difference of the conveyance movement between the conveyance machines and the phase difference between the raise/lower movement of the respective press machines and the conveyance movement of the respective conveyance machines is set again, after setting the line speed to a smaller value. Therefore, the phase difference between the raise/lower movement of the respective press machines and the conveyance movement of the respective conveyance machines is set within an operable region by reducing the line speed that had been provisionally set to a maximum value in a previous process. Therefore, the phase difference between the raise/lower movement and the conveyance movement can be set within the operable region while holding the reduction of line speed to a minimum.

In this case, it is preferable to further include a machining speed optimizing step (e.g., Steps S12, S13, S14 in FIG. 3 described later) of setting the machining speed to a smaller value so that a clearance (e.g., ΔU1, ΔU2 described later) between a conveyance machine or work conveyed by this conveyance machine and the upper mold is a minimum under the conveyance route of each of the conveyance machines, the phase difference of conveyance movement between each of the conveyance machines, the line speed, the machining speed, and the phase difference between the raise/lower movement of each of the press machines and the conveyance movement of each of the conveyance machines.

According to the present invention, the machining speed of the respective press machines is set so that the clearances between the conveyance machine or work conveyed by this conveyance machine and the upper mold become a minimum under the conveyance route, phase difference of conveyance movement between the respective conveyance machines and line speed thus set as described above. Therefore, it is possible to set the machining speed of the respective press machines to the minimum without reducing the line speed, i.e. production cycle of the press line overall. The electric power required in order to drive the press machines can thereby be made the minimum. In addition, the load on the press machines and the impact load on the molds can also be made minimums.

Effects of the Invention

According to the method for setting an operation condition of a press line of the present invention, since by simply determining the shape of the conveyance machine and molds of the press machine, the optimum line speed, conveyance route and conveyance movement of the conveyance machine, i.e. conveyance movement of the conveyance machine, can be set automatically in accordance with this shape, the production cycle of this press line can be improved. In addition, since insight into the production cycle of the press line is possible at the design stage of the molds, the production schedule of the press line can be constructed at an early stage.

PREFERRED MODE FOR CARRYING OUT THE INVENTION

Hereinafter, an embodiment of the present invention will be explained based on the drawings.

Figure 1:
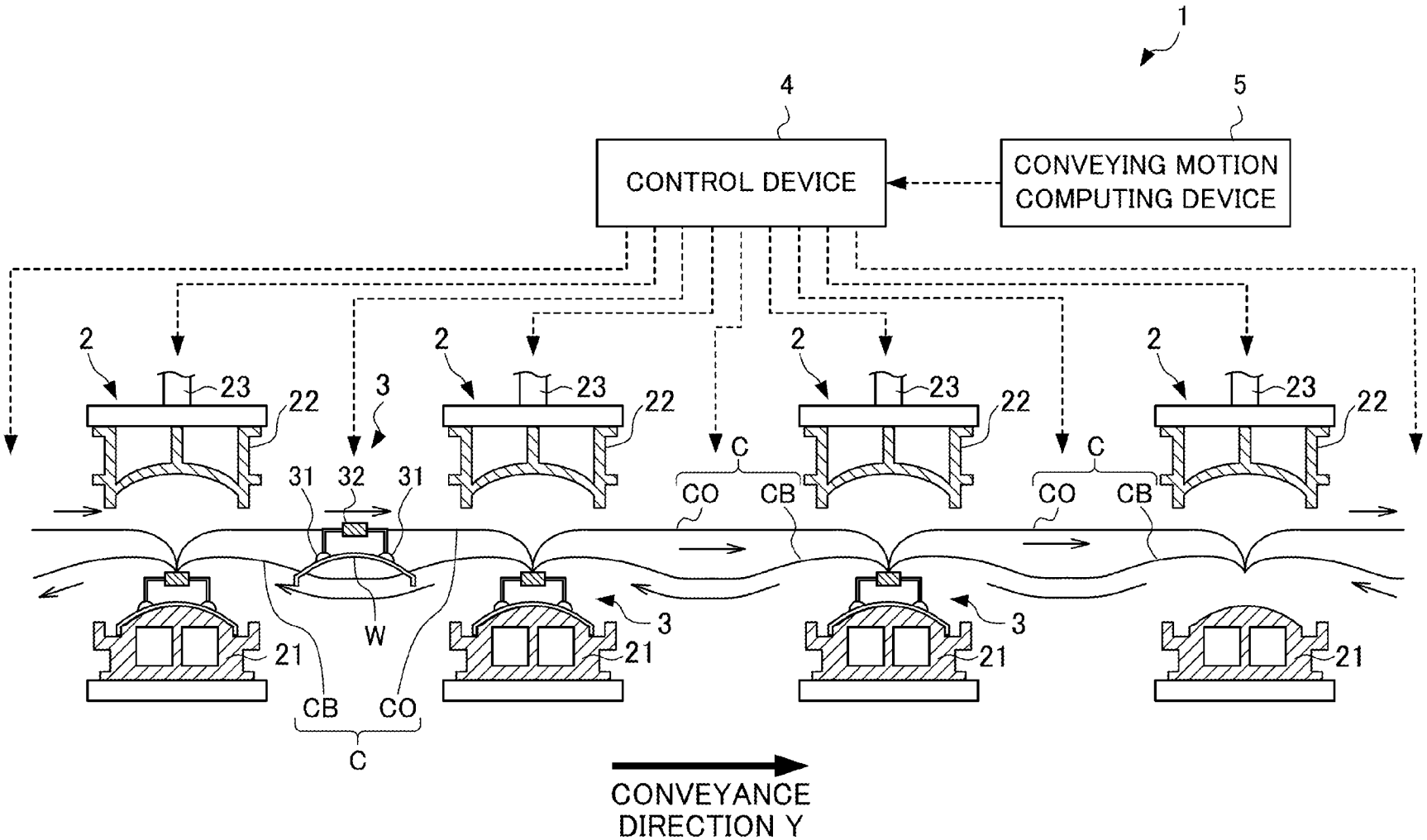
FIG. 1 is a view showing a schematic configuration of a press line to which the method for setting an operation condition according to an embodiment of the present invention has been applied.

FIG. 1 is a view showing a schematic configuration of a press line 1 to which the method for setting an operation condition according to an embodiment of the present invention has been applied.

The press line 1 includes a plurality of press machines 2 that machine a work W, a plurality of conveyance machines 3 that are provided to accompany each press machine 2 and convey the work W between these press machines 2, and a control device 4 that controls the movement of each press machine 2 and the movement of each conveyance machine 3.

The press line 1 manufactures an article of a predetermined shape from a work of a flat plate shape through a plurality of pressing processes by each press machine 2. The plurality of press machines 2 is disposed in the same order as the advancement of pressing processes, and to each press machine 2, a pressing process is respectively assigned. In the present embodiment, the pressing processes are made to advance in order from the left side to the right side in FIG. 1. In addition, the conveyance direction Y in which each conveyance machine conveys a work is set to be the same as the direction in which these pressing processes advance.

Each press machine 2 has a lower mold 21 disposed below the work W, an upper mold 22 disposed to oppose this lower mold 21, an raise/lower mechanism 23 that causes the upper mold 22 to approach and separate relative to the lower mold 21, and a controller, which is not illustrated, that controls this raise/lower mechanism 23. The above press machine 2 presses the work W by raising and lowering the upper mold 22 relative to the lower mold 21.

Each conveyance machine 3 has a crossbar 32 to which a plurality of vacuum cups 31 is connected, a transfer device, which is not illustrated, that moves the crossbar 32 along a conveyance route C established between adjacent press machines, and a controller, which is not illustrated, that controls this transfer device.

As shown in FIG. 1, the conveyance route C of each conveyance machine 3 is configured to include an outbound route CO extending from a press machine 2 executing an earlier pressing process to a press machine 2 executing a subsequent pressing process, and a return route CB extending from the press machine 2 executing the subsequent pressing process to the press machine 2 executing the earlier pressing process. Each conveyance machine 3 moves the crossbar 32 along such a conveyance route C between adjacent press machines 2, and conveys the work W on which machining has been performed by the press machine 2 corresponding to the earlier pressing process to the press machine 2 corresponding to the subsequent pressing process. In other words, the conveyance machine 3 moves on the outbound route CO while retaining a work W, and travels free without retaining a work W in the return route CB.

Each conveyance machine 3 operates as follows to convey a work W.

First, it moves the crossbar 32 along the return path CB between the upper mold 22 and lower mold 21 of the press machine 2 corresponding to the earlier pressing process.

Then, it suctions a machined work W with the vacuum cups 31 to retain this work W.

Next, it moves the crossbar 32 along the outbound path CO while still retaining the work W, between the upper mold 22 and lower mold 21 of the press machine 2 corresponding to the subsequent pressing process.

Subsequently, it places the retained work W on the lower mold 21 of the press machine 2.

The control device 4 transmits control signals to the controller of each press machine 2 and each conveyance machine 3 based on predetermined pressing motion data and conveying motion data to control cyclic raise/lower movements (hereinafter referred to as "pressing motion") of each press machine 2 and cyclic conveyance movements (hereinafter referred to as "conveying motion") of each conveyance machine 3.

The conveying motion computing device 5 reads pressing motion data defining the pressing motion of each press machine 2, generates conveying motion data defining the conveying motion of each conveyance machine 3, and further transmits this pressing motion data and conveying motion data to the control device 4.

Herein, the contents of the pressing motion data and the conveying motion data will be explained.

Information relating to the pressing motion such as the speed, position and time to drive the upper mold 22 of each press machine 2 is included in the pressing motion data defining the pressing motion. This speed at which to drive the upper mold 22 is characterized as a machining speed indicating the work machining capacity of the press machine 2, i.e. press SPM. Therefore, this press SPM increases as the cycle to raise and lower the upper mold 22 shortens.

Information relating to the conveyance route C of each conveyance machine 3 and the speed to drive the conveyance machine 3 along this conveyance route C is included in the conveying motion data defining the conveying motion. In the present embodiment, the conveyance route C of the conveyance machine 3 is defined as the trajectory of a central position of the crossbar 32 within three-dimensional space.

Additionally, information relating to production capacity of the work, i.e. line SPM as the line speed indicating the quantity of works that the press line 1 can machine in one minute, is included in the conveying motion data. In other words, the production cycle of the press line 1 can be raised by setting this line SPM to be a large value. In addition, the speed and time at which to drive each conveyance machine 3 are set in accordance with this line SPM.

Moreover, in order to control a plurality of the conveyance machines 3 repeating cyclic conveying motions, information relating to the phase difference of the conveying motion between the respective conveyance machines 3 (hereinafter referred to as "conveyance machine phase difference") is included in the conveying motion data.

Furthermore, in order to control the respective press machines 2 repeating cyclic pressing motions and the respective conveyance machines 3 repeating cyclic conveying motions, information relating to the phase difference between the conveying motion of the respective press machines 2 and the conveying motion of the respective conveyance machines 3 (hereinafter referred to as "press-conveyance phase difference") is included in the conveying motion data.

Figure 2:
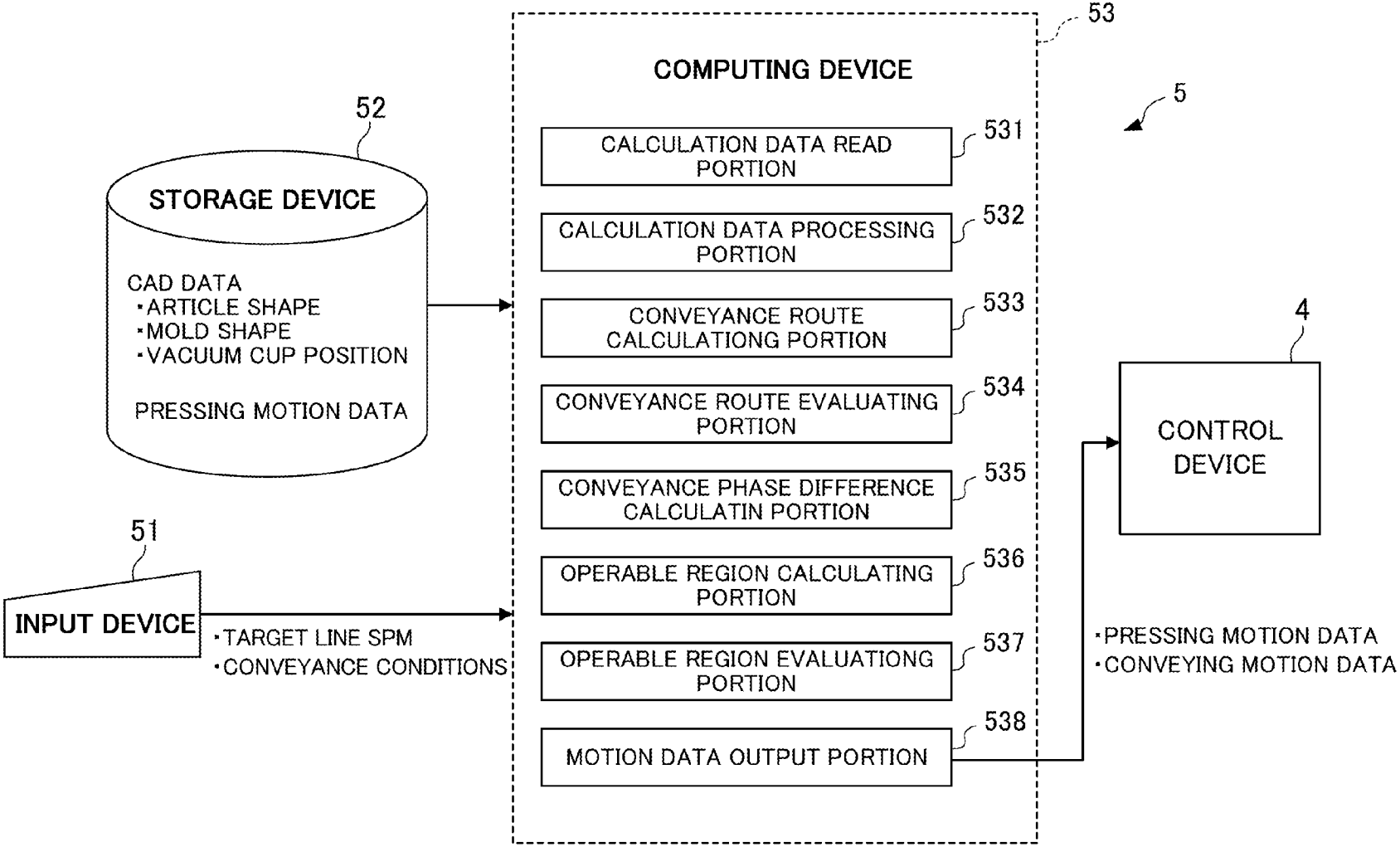
FIG. 2 is a block diagram showing the configuration of a conveying motion computing device according to the embodiment.

The conveying motion computing device 5 transmits pressing motion data and conveying motion data including information such as that described above to the control device FIG. 2 is a block diagram showing the configuration of the conveying motion computing device 5.

The conveying motion computing device 5 is configured to include an input unit 51, storage unit 52, and computing unit 53.

The input unit 51 is configured by hardware such as a keyboard and a mouse operable by an operator. Data and commands input by way of operating this input unit 51 are input to the computing unit 53.

The storage unit 52 is configured by hardware such as a hard disk and CDROM. Various data is stored in this storage unit 52, and the data thus stored is input as appropriate to the computing unit 53.

The computing unit 53 is configured by hardware such as a CPU, ROM and RAM. This computing unit 53 includes a plurality of functional blocks that are realized by this hardware. More specifically, the computing unit 53 is configured to include a calculation data reading portion 531, a calculation data processing portion 532, a conveyance route calculating portion 533, a conveyance route evaluating portion 534, a conveyance machine phase difference calculating portion 535, an operable region calculating portion 536, an operable region evaluating portion 537, and a motion data output portion 538.

CAD data defining the shapes of the upper mold and lower mold of each press machine, the shape of the work at each process, and the position of the vacuum cups of each conveyance machine is stored in the storage unit 52. In addition to CΔD data, pressing motion data set in advance is stored in the storage unit 52.

Figure 3:
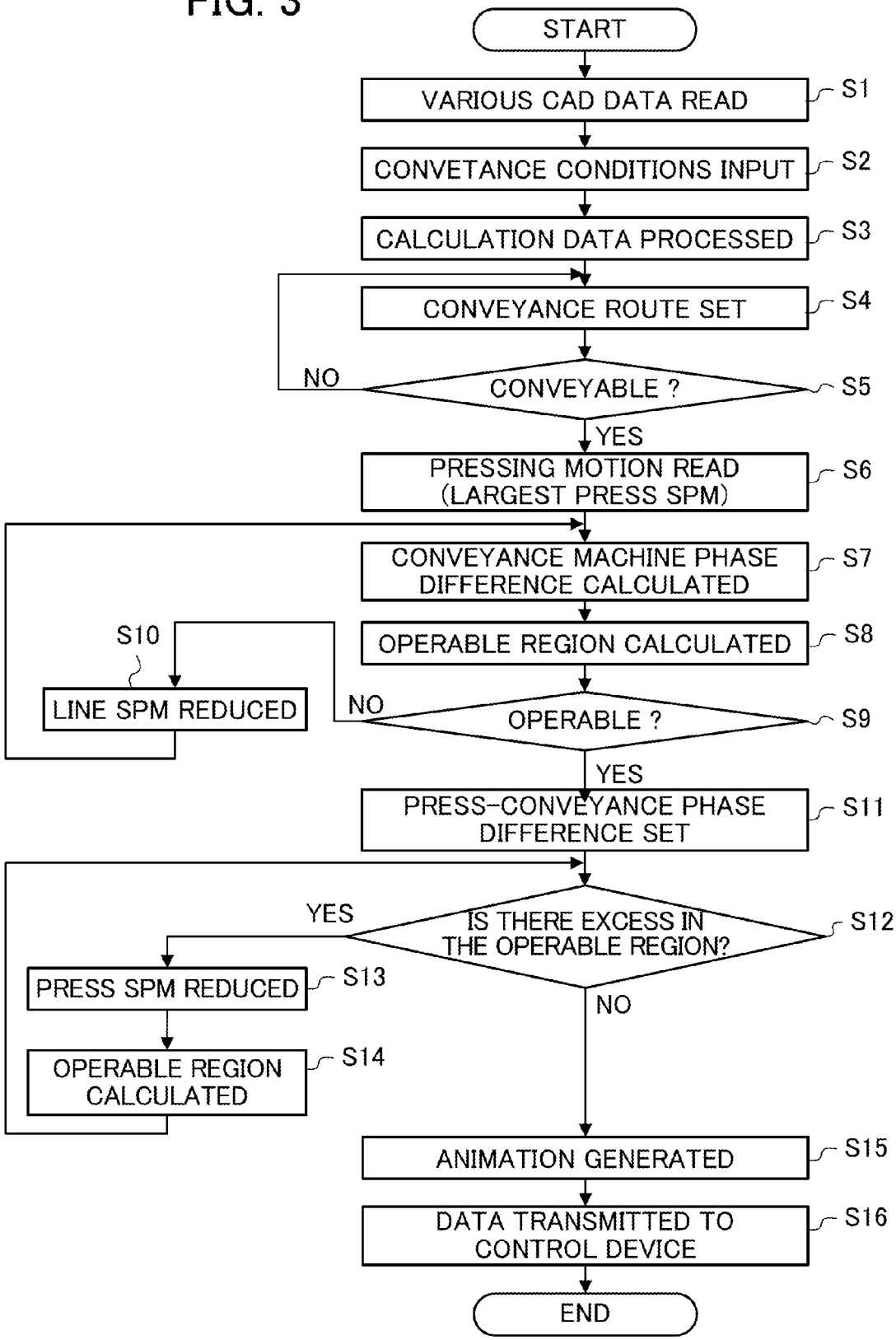
FIG. 3 is a flowchart illustrating a sequence to generate conveying motion data and pressing motion data by the conveying motion computing device according to the embodiment.

The calculation data reading portion 531 reads various CΔD data stored in the storage unit 52 (refer to Step S1 in FIG. 3 described later).

The calculation data processing portion 532 conducts preprocessing on the CΔD data read by the calculation data reading portion 531 to reduce the load on calculation (refer to Step S2 in FIG. 3 described later).

The conveyance route calculating portion 533 calculates the conveyance route C of each conveyance machine based on the CΔD data on which preprocessing had been conducted and various conveyance conditions including the line SPM (refer to Step S4 in FIG. 3 described later).

The conveyance route evaluating portion 534 evaluates the conveyance route C calculated by the conveyance path calculating portion 533, and determines whether conveying a work along the conveyance route C is actually possible (refer to Step S5 in FIG. 3 described later).

The conveyance machine phase difference calculating portion 535 computes the conveyance machine phase difference based on the conveyance route C calculated by the conveyance route calculating portion 533 and the line SPM input from the input unit 51 (refer to Step S7 in FIG. 3 described later).

The operable region calculating portion 536 reads the pressing motion data stored in the storage unit 52. Furthermore, in a case of operating the press line with this read pressing motion data and with the conveyance route C and conveyance machine phase difference thus set, it calculates the operable region in which the press-conveyance phase difference can be set without the upper mold and the conveyance machine or the work conveyed by this conveyance machine interfering (refer to Step S8 in FIG. 3 described later).

The operable region evaluating portion 537 evaluates the operable region thus calculated, and determined whether the operable region could be ensured for all of the press machines. In the case that the operable region could be ensured, the press-conveyance phase difference is set within this region (refer to Step S9 in FIG. 3 described later).

The motion data output portion 538 transmits the pressing motion data and conveying motion data thus calculated in the above way to the control device 4 (refer to Step S16 in FIG. 3 described later).

Next, the sequence in which pressing motion data and conveying motion data is generated and transferred to the control device by the conveying motion computing device 5 will be explained while referring to the flowchart shown in FIG. 3.

In Step S1, various CΔD data is read. In this step, CΔD data defining the shapes of the lower mold and upper mold of each press machine, the shape of the work at each pressing process, and the position of the vacuum cups of each conveyance machine is read from the storage unit.

In Step S2, the conveyance conditions are input. Herein, conveyance conditions indicate various set values that are necessary when conveying the work by the conveyance machine. More specifically, in addition to the aforementioned line SPM, set values such as the height of the crossbar when suctioning the work, the lift amount and feed amount of the work relative to the lower mold, and an amount related to the attitude at which the work is retained when conveying the work are included in these conveyance conditions.

In addition, the line SPM is set to a provisional maximum value in this step. Herein, the line SPM set to the maximum value is reset to an appropriate value in the processes of Steps S7 to S11 described in detail later.

In Step S3, calculation data processing is performed. In this step, preprocessing of the CΔD data read in Step S1 is performed to reduce the load on computation of the conveyance route C and the operable region described later.

In Step S4, the conveyance route C is set.

Figure 4:
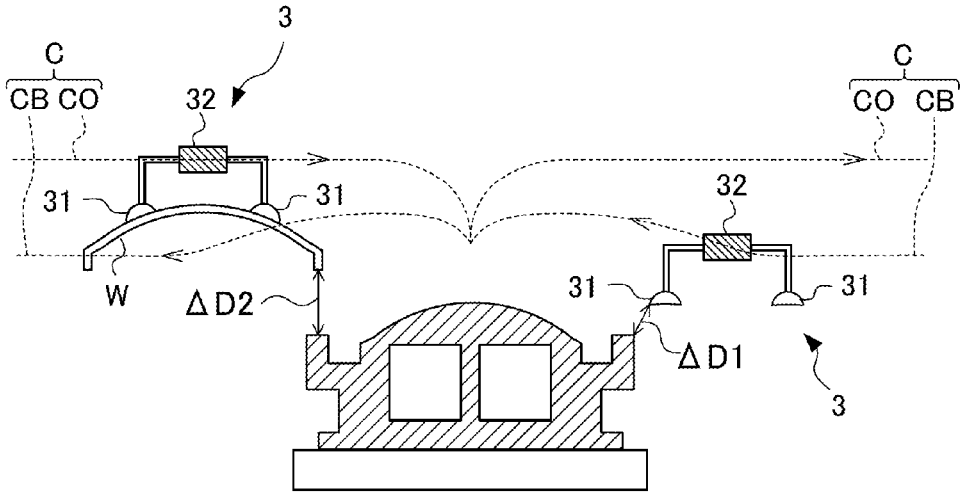
FIG. 4 is a schematic diagram illustrating a conveyance route and the configuration of a crossbar of the conveyance machine that moves along this conveyance route according to the embodiment.

FIG. 4 is a schematic diagram illustrating the conveyance route C and the configuration of the crossbar 32 of the conveyance machine 3 that moves along this conveyance route C.

As shown in FIG. 4, the conveyance route C is set such that a clearance ΔD1 or ΔD2 between the conveyance machine 3, or the work W conveyed by the conveyance machine 3, and the lower mold 21 becomes a minimum.

On the return route CB of the conveyance route C, the conveyance machine 3 runs free without retaining a work W. As a result, the return route CB is set such that the clearance D1 between the vacuum cups 31 of the conveyance machine 3 and the lower mold 21 becomes a minimum.

On the outbound route CO of the conveyance route C, the conveyance machine 3 moves while retaining the work W. As a result, the outbound route CO is set such that the clearance D2 between the work W retained by the conveyance machine 3 and the lower mold 21 becomes a minimum.

In this way, it is possible to easily avoid interference between the upper mold 22 raised relative to the lower mold 21 and the conveyance machine 3, by setting the conveyance route C so that the clearance with the lower mold 21 becomes a minimum.

Referring back to FIG. 3, in Step S5, it is determined whether conveyance of a work along the conveyance route C set is possible. In this step, it is determined whether conveyance of the work along the conveyance route C is practically possible, by computing the load on the transfer device moving this crossbar 32 and the like, in the case of moving the crossbar 32 along the conveyance route C. In a case of this determination being YES, Step S6 is advanced to, and in a case of being NO, Step S4 is advanced to, and the conveyance route C for which conveyance is possible is reset.

In Step S6, pressing motion data is read. In this step, among the plurality of pressing motion data set in advance and stored in the storage unit, pressing motion data for which the press SPM is a maximum is read. The press SPM is thereby provisionally set to a maximum value. This press SPM of the respective press machines is reset to an appropriate value in the processes of Steps S12 to S14 described in detail later.

In Step S7, the phase difference between the conveyance machines 3 is calculated.

Figure 5:
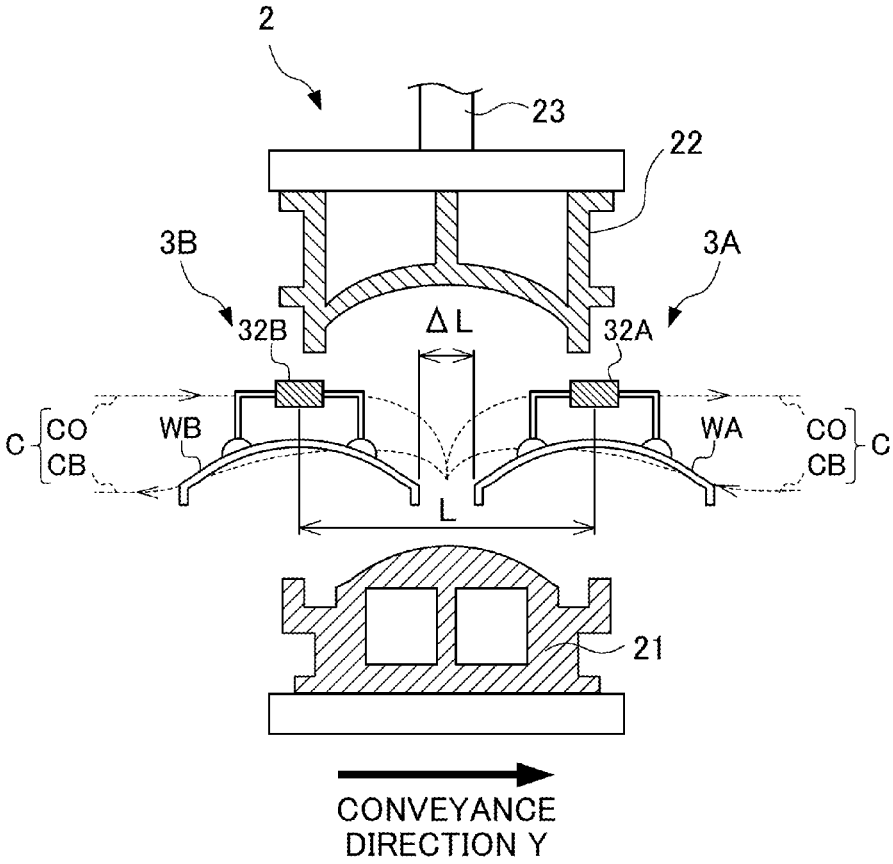
FIG. 5 is a view showing an appearance when two conveyance machines are present simultaneously within the molds of a press machine according to the embodiment.

FIG. 5 is a view showing an appearance when two conveyance machines 3A, 3B are present simultaneously within the molds of a press machine 2. More specifically, FIG. 5 is a view showing an appearance, after a work WA has been machined by the press machine 2, in which an unmachined work WB is delivered by the conveyance machine 3B while this machined work WA is discharged by the conveyance machine 3A.

In order to set the press SPM of the press machine 2 to a large value, it is preferable for the time lag between the time at which the machined work WA is discharged from the press machine 2 and the time at which the unmachined work WB is delivered to the press machine 2 to be made as short as possible. In other words, it is preferable for the time for which the two conveyance machines 3A, 3B stay within the molds to be reduced as much as possible. Therefore, the phase difference between the conveyance machines 3A, 3B is set so that the clearance ΔL, along the conveying direction Y within the molds of the press machine 2, between the machined work WA discharged from the press machine 2 and the unmachined work WB delivered to this press machine 2, becomes a minimum.

In Step S8, the operable region is calculated. Herein, the operable region indicates the region in which the press-conveyance phase difference ΔTP can be set without the upper mold and the conveyance machine or the work retained to this conveyance machine causing interference, in a case of operating the press line under the conveyance route C, conveyance machine phase difference ΔTH, line SPM, and press SPM of the respective conveyance machines thus set.

Figure 6:
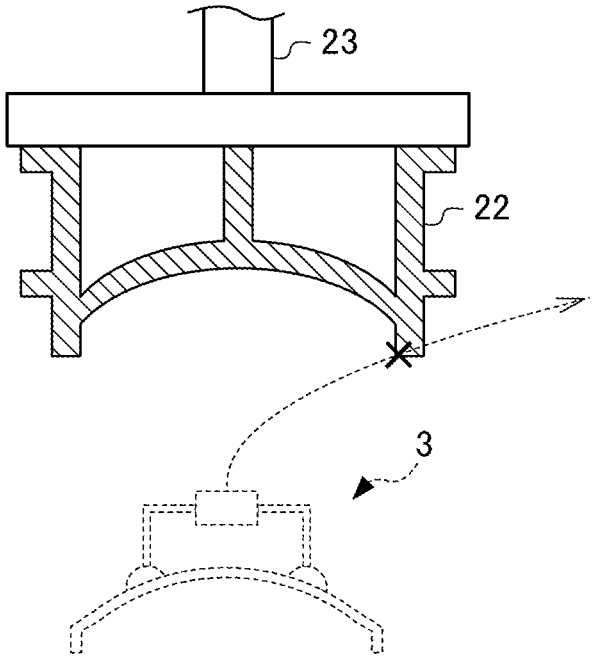
FIG. 6 is a view showing a trajectory of the crossbar of a conveyance machine viewed from the upper mold according to the embodiment.

FIG. 6 is a view showing a trajectory of the crossbar 32 of the conveyance machine 3 viewed from the upper mold 22. More specifically, FIG. 6 is an illustration viewing, from a static system of the upper mold 22, the trajectory of the crossbar 32 moving along the conveyance route thus set, in a case of raising the upper mold 22 under a predetermined press-conveyance phase difference.

When the press-conveyance phase difference ΔTP is changed, the conveyance machine or the work retained to this conveyance machine may interfere with the upper mold, as shown by the "X" symbol in FIG. 6. Therefore, with the region in which the press-conveyance phase difference ΔTP can be set without the upper mold and the conveyance machine or work interfering as the operable region this operation region is calculated in this step.

Figure 7:
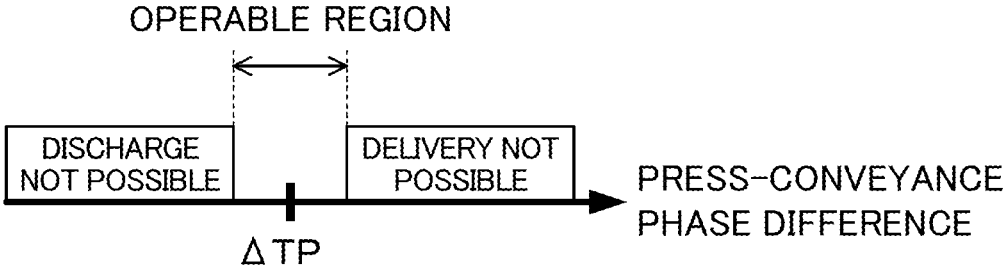
FIG. 7 is a view showing an operable region of press-conveyance phase difference according to the embodiment.

FIG. 7 is a view showing an operable region of press-conveyance phase difference.

As shown in FIG. 7, a region in which the upper mold and conveyance machine interfere and discharging is not possible, and a region in which delivery is not possible are included in the press-conveyance phase difference. Therefore, the operable region is limited to a region in which delivery and discharge are possible.

In this step, the operable region in which the press-conveyance phase difference can be set, such as that shown in FIG. 7, is calculated for each press machine.

In Step S9, it is determined whether or not operable, i.e. whether or not the operable region for all press machines in Step S8 could be ensured.

In a case of this determination being YES, Step S11 is advanced to, and after the press-conveyance phase difference ΔTP has been set to substantially the middle of the operable region, Step S12 is advanced to.

In a case of this determination being NO, Step S10 is advanced to, and after the line SPM has been set to a smaller value, Step S7 is advanced to. In other words, the line SPM is reduced until the operable region is ensured in all press machines.

Referring back to FIG. 3, in Step S12, it is determined whether there is excess in the operable region for respective press machines calculated in Step S8.

In a case of this determination being YES, i.e. in a case of there being excess in the operable region, Step S13 is advanced to, and after the press SPM of press machines having excess have been set to a smaller value, Step S14 is advanced to. In Step S14, the operable region is recalculated under the press SPM thus set, and Step S12 is advanced to.

In a case of this determination being NO, setting of the pressing motion data and conveying motion data is ended, and Step S15 is advanced to.

Figure 8:
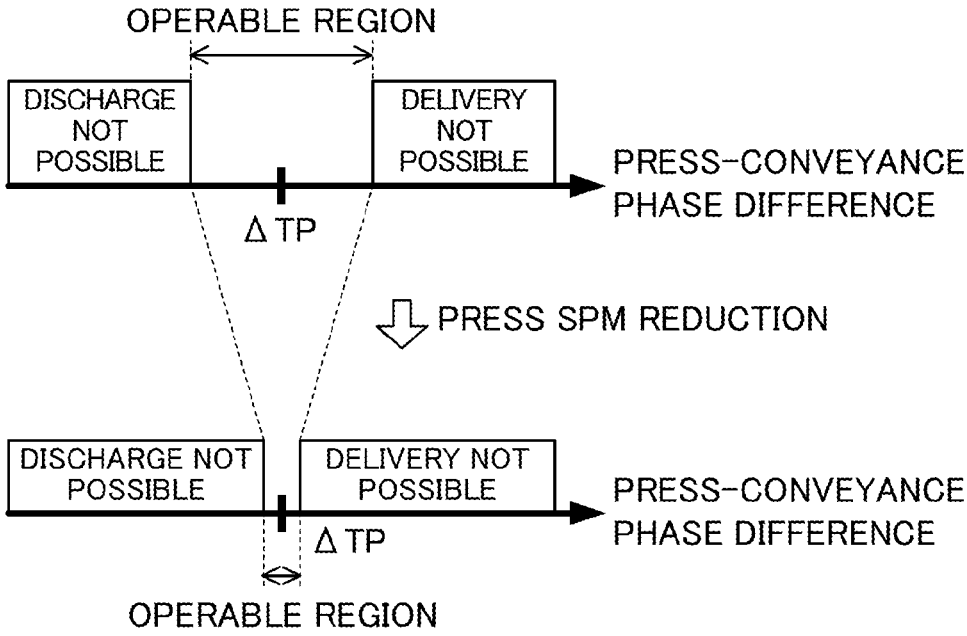
FIG. 8 is a view showing a change in the operable region in a case of a press SPM being reduced according to the embodiment.

FIG. 8 is a view showing a change in the operable region in a case of the press SPM being reduced.

Figure 9:
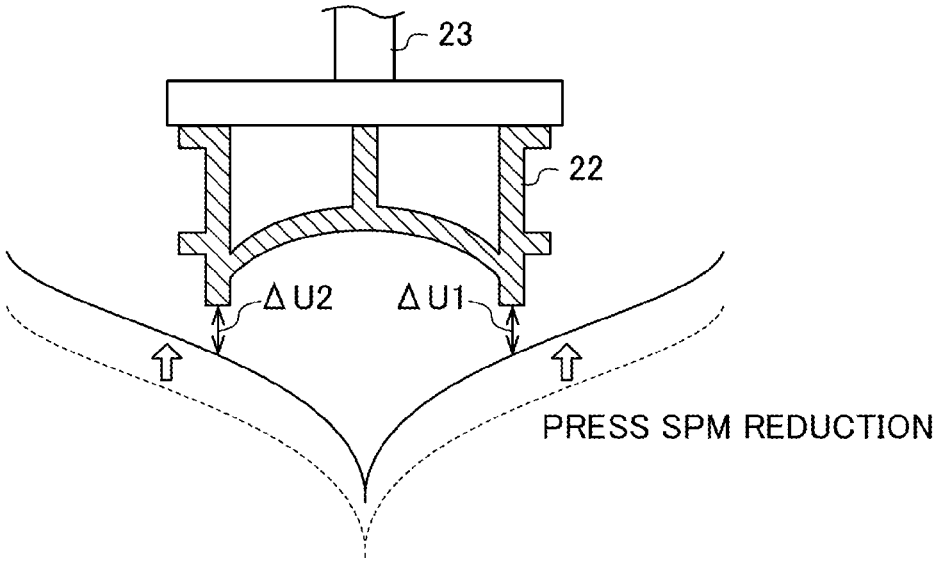
FIG. 9 is a view showing a change in the trajectory of the crossbar of the conveyance machine viewed from the top mold, in a case of the press SPM being reduced according to the embodiment.

FIG. 9 is a view showing a change in the trajectory of the crossbar 32 of the conveyance machine 3 viewed from the top mold 22, in a case of the press SPM being reduced.

As shown in FIG. 8, the operation region narrows when only the press SPM is reduced while the line SPM is kept as is. In addition, as shown in FIG. 9, when the press SPM is reduced and the operable region narrows, the clearance ΔU1 between the trajectory of the crossbar and the upper mold 22 during conveyance and the clearance ΔU2 between the trajectory of the cross bar and the upper mold 22 when delivering become small.

Therefore, in Steps S12 to S14, the press SPM is reduced until the clearances ΔU1 and ΔU2 between the upper mold 22 and trajectory of the cross bar become a minimum under the conveyance route C, respective conveyance machine phase difference ΔTH, line SPM, and press-conveyance phase difference ΔTP of each conveyance machine thus set.

Referring back to FIG. 3, in Step S15, an animation replicating the pressing motion of the press machines and conveying motion of the conveyance machines is generated under the pressing motion data and conveying motion data thus set. The operator views this animation to perform final confirmation of the pressing motion data and conveying motion data.

In Step S16, the pressing motion data and conveying motion data are transmitted to the control device, and then this processing is ended.

There are the following operational effects according to the present embodiment.

(1) Since the conveyance route C of the conveyance machine 3 is set such that the clearances ΔD1, ΔD2 between the conveyance machine 3 or the work conveyed by this conveyance machine 3 and the lower mold 21 become a minimum after the line SPM has been set, it is possible to make the interference with the upper mold 22 the minimum. In addition, since the conveyance machine phase difference ΔTH is set so that the clearance ΔL between the work discharged from the press machine 2 and the work delivered to this press machine becomes a minimum, after having set the press SPM of the press machine 2, it is possible to make the mold-inside time for which the two conveyance machines simultaneously stay within one press machine 2 a minimum. In addition, the press-conveyance phase difference ΔTP between the pressing motion of respective press machines 2 and the conveying motion of respective conveyance machines 3 is set based on the conveyance route of respective conveyance machines, phase difference of conveying movements between respective conveyance machines, line SPM, and press SPM set as above.

As stated above, since by simply determining the shape of the conveyance machine 3 and molds of the press machine 2, the optimum line SPM, conveyance route C and conveyance machine phase difference ΔTH, i.e. conveying motion of the conveyance machine 3, can be set automatically in accordance with this shape, the production cycle of this press line 1 can be improved. In addition, since insight into the production cycle of the press line is possible from the stage of designing the molds, the production schedule of the press line can be constructed at an early stage.

(2) The conveyance route C of the conveyance machine 3, the phase difference of conveying motion between respective conveyance machines 3, and the phase difference ΔTP between the pressing motion of the respective press machines 2 and the conveying motion of the respective conveyance machines 3 are set after setting the line SPM and press SPM to minimum values, respectively. It is thereby possible to set the pressing motion of the press machine 2 and the conveying motion of the conveyance machine 3 so that the production cycle of the press line can be improved overall.

(3) It is determined whether the phase difference between the pressing motion of the respective press machines 2 and the conveying motion of the respective conveyance machines 3 can be set within an operable region, and in a case of having been determined not to be settable, the phase difference of the conveying motion between the conveyance machines 3 and the phase difference ΔTP between the pressing motion of the respective press machines 2 and the conveying motion of the respective conveyance machines is set again, after setting the line SPM to a smaller value. Therefore, the phase difference ΔTP between the pressing motion of the respective press machines 2 and the conveying motion of the respective conveyance machines is set within an operable region by reducing the line SPM that had been provisionally set to a maximum value in a previous process. Therefore, the press-conveyance phase difference ΔTP can be set within the operable region while holding the reduction of line SPM to a minimum.

(4) The press SPM of the respective press machines 2 is set so that the clearances ΔU1, ΔU2 between the conveyance machine 3 or work conveyed by this conveyance machine 3 and the upper mold 22 become a minimum under the conveyance route C, respective conveyance machine phase difference ΔTH and line SPM thus set as described above. Therefore, it is possible to set the press SPM of the respective press machines 2 to the minimum without reducing the line SPM, i.e. production cycle of the press line 1 overall. The electric power required in order to drive the press machines 2 can thereby be made the minimum. In addition, the load on the press machines 2 and the impact load on the molds 21 and 22 can also be made minimums.

It should be noted that the present invention is not to be limited to the embodiment, and that modifications, improvements, etc. within a scope that can achieve the object of the present invention are included in the present invention.

Although a method for setting operation conditions of the press line 1 including four processes, i.e. four press machines 2, have been explained in the above embodiment, the number of press machines included in the press line is not limited thereto.

EXPLANATION OF REFERENCE NUMERALS

1 Press line
2 Press machine
21 Lower mold
22 Upper mold
3 Conveyance machine
4 Control device
5 Conveying motion computing device

The invention claimed is:

1. A method for setting an operation condition of a press line provided with a plurality of press machines that presses a work by raising and lowering an upper mold relative to a lower mold, a plurality of conveyance machines that conveys a work between the press machines along a predetermined conveyance route, and a control device that controls cyclic raise/lower movement of each of the press machines and cyclic conveyance movement of each of the conveyance machines along the conveyance route, the method comprising:

a line speed setting step of setting a line speed indicating a work production capacity of the press line;

a conveyance route setting step of setting a conveyance route of the conveyance machine so that a clearance between the conveyance machine or the work conveyed by the conveyance machine and the lower mold is a minimum;

a machining speed setting step of setting a machining speed indicating a work machining capacity of the press machine;

a conveyance machine phase difference setting step of setting a phase difference of conveyance movement between each of the conveyance machines so that a clearance between a work discharged from the press machine and a work delivered to the press machine is a minimum; and a press-conveyance phase difference setting step of setting a phase difference between raise/lower movement of each of the press machines and conveyance movement of each of the conveyance machines based on the conveyance route of each of the conveyance machines, the phase difference of conveyance movement between each of the conveyance machines, the line speed, and the machining speed thus set in the steps.

2. The method for setting an operation condition of a press line according to claim 1, wherein the line speed and the machining speed are set to maximum values in the line speed setting step and the machining speed setting step, respectively.

3. The method for setting an operation condition of a press line according to claim 2, further comprising:

an operability determination step of determining whether the phase difference between raise/lower movement of each of the press machines and the conveyance movement of each of the conveyance machines set in the press-conveyance phase difference setting step can be set within an operable region, wherein the line speed is set to a smaller value, and the conveyance machine phase difference setting step, the press-conveyance phase difference setting step, and the operability determination step are executed again, in a case of the phase difference being determined not to be settable within the operable region in the operability determination step, and wherein the phase difference is set within the operable region in a case of the phase difference having been determined to be settable within the operable region in the operability determination step.

4. The method for setting an operation condition of a press line according to claim 3, further comprising:

a machining speed optimizing step of setting the machining speed to a smaller value so that a clearance between a conveyance machine or work retained to this conveyance machine and the upper mold is a minimum under the conveyance route of each of the conveyance machines, the phase difference of conveyance movement between each of the conveyance machines, the line speed, the machining speed, and the phase difference between the raise/lower movement of each of the press machines and the conveyance movement of each of the conveyance machines.

* * * * *